United States Patent [19]

Rioja et al.

[11] Patent Number: 5,066,342

[45] Date of Patent: Nov. 19, 1991

[54] ALUMINUM-LITHIUM ALLOYS AND METHOD OF MAKING THE SAME

[75] Inventors: Roberto J. Rioja, Lower Burrell, Pa.; Joel A. Bowers, Bettendorf, Iowa; R. Steve James, Gibsonia, Pa.

[73] Assignee: Aluminum Company of America, Pittsburgh, Pa.

[21] Appl. No.: 367,791

[22] Filed: Jun. 19, 1989

Related U.S. Application Data

[63] Continuation-in-part of Ser. No. 149,802, Jan. 28, 1988.

[51] Int. Cl.[5] ..... C22F 1/04

[52] U.S. Cl. ..... 148/12.7 A; 148/415; 148/416; 148/417; 148/437; 148/438; 148/439; 148/440; 420/532

[58] Field of Search ..... 148/12.7 A, 2, 415–418, 148/437–440; 420/532

[56] References Cited

U.S. PATENT DOCUMENTS

| | | | |
|---|---|---|---|
| 2,915,390 | 12/1959 | Criner | 75/141 |
| 4,094,705 | 6/1978 | Sperry et al. | 148/2 |
| 4,571,272 | 2/1986 | Grimes | 148/11.5 |
| 4,582,544 | 4/1986 | Grimes et al. | 148/11.5 |
| 4,603,029 | 7/1986 | Quist et al. | 420/535 |
| 4,626,409 | 12/1986 | Miller | 420/533 |
| 4,636,357 | 1/1987 | Peel et al. | 420/532 |
| 4,648,913 | 3/1987 | Hunt, Jr. et al. | 148/12.7 |
| 4,790,884 | 12/1988 | Young et al. | 148/2 |
| 4,795,502 | 1/1989 | Cho | 148/2 |
| 4,797,165 | 1/1989 | Bretz et al. | 148/12.7 |
| 4,806,174 | 2/1989 | Cho et al. | 148/12.7 |
| 4,816,087 | 3/1989 | Cho | 148/2 |
| 4,832,910 | 5/1989 | Rioja et al. | 420/528 |
| 4,844,750 | 7/1989 | Cho et al. | 148/12.7 |
| 4,861,391 | 8/1989 | Rioja et al. | 148/12.7 |
| 4,869,870 | 9/1989 | Rioja et al. | 420/532 |
| 4,897,126 | 1/1990 | Bretz et al. . | |

FOREIGN PATENT DOCUMENTS

| | | |
|---|---|---|
| 150456 | 8/1985 | European Pat. Off. . |
| 156995 | 10/1985 | European Pat. Off. . |
| 158769 | 10/1985 | European Pat. Off. . |
| 210112 | 6/1986 | European Pat. Off. . |
| 3613224 | 4/1986 | Fed. Rep. of Germany . |
| 85/02416 | 6/1985 | PCT Int'l Appl. . |
| 1387586 | 3/1975 | United Kingdom . |
| 2127847 | 3/1986 | United Kingdom . |

OTHER PUBLICATIONS

"Microstructure and Toughness of High Strength Aluminum Alloys" by J. T. Staley, ASTM STP 605, pp. 71–103.

*Primary Examiner*—R. Dean
*Assistant Examiner*—Robert R. Koehler
*Attorney, Agent, or Firm*—Andrew Alexander

[57] ABSTRACT

An aluminum base alloy wrought product having an isotropic texture and a process for preparing the same is disclosed. The product has the ability to develop improved properties in the 45° direction or more uniform properties throughout the thickness and in the short transverse direction in response to an aging treatment and is comprised of 0.2 to 5.0 wt. % Li, 0.05 to 6.0 wt. % Mg, at least 2.45 wt. % Cu, 0.1 to 1.0 wt. % Mn, 0.05 to 12 wt. % Zn, 0.5 wt. % max. Fe, 0.5 wt. % max. Si, the balance aluminum and incidental impurities. The product has imparted thereto, prior to a hot rolling step, a recrystallization effect to provide therein after hot rolling a metallurgical structure generally lacking intense work texture characteristics. After an aging step, the product has improved levels of properties in the 45° direction or more uniform properties throughout the thickness and in the short transverse direction.

46 Claims, 1 Drawing Sheet

5066342

ALUMINUM-LITHIUM ALLOYS AND METHOD OF MAKING THE SAME

CROSS REFERENCE TO RELATED APPLICATIONS

This application is a continuation-in-part of U.S. Ser. No. 149,802, filed Jan. 28, 1988.

BACKGROUND OF THE INVENTION

This invention relates to aluminum base alloy products, and more particularly, it relates to improved lithium containing aluminum base alloy products and a method of producing the same.

In the aircraft industry, it has been generally recognized that one of the most effective ways to reduce the weight of an aircraft is to reduce the density of aluminum alloys used in the aircraft construction. For purposes of reducing the alloy density, lithium additions have been made. However, the addition of lithium to aluminum alloys is not without problems. For example, the addition of lithium to aluminum alloys often results in a decrease in ductility and fracture toughness. Where the use is in aircraft parts, it is imperative that the lithium containing alloy have both improved fracture toughness and strength properties.

However, in the past, aluminum-lithium alloys have exhibited poor transverse ductility and toughness. That is, aluminum-lithium alloys have exhibited quite low elongation and toughness properties which has been a serious drawback in commercializing these alloys.

These properties appear to result from the anistropic nature of such alloys on working by rolling, for example. This condition is sometimes also referred to as a fibering arrangement. The properties across the fibering arrangement are often inferior to properties measured in the direction of rolling or longitudinal direction, particularly for thick products such as plate and forgings, for example. Also, properties measured at 45° with respect to the principal direction of working can also be inferior. By the use of 45° properties herein is meant to include off-axis properties, i.e., properties between the longitudinal and long transverse directions, e.g., 20 to 75° because the lowest properties are not always located in the 45° direction. Thus, there is a great need to produce a lithium containing aluminum alloy having an isotropic type structure capable of maximizing the properties in all directions.

With respect to conventional alloys, both high strength and high fracture toughness appear to be quite difficult to obtain when viewed in light of conventional alloys such as AA (Aluminum Association) 2024-T3X and 7050-TX normally used in aircraft applications. For example, a paper by J. T. Staley entitled "Microstructure and Toughness of High-Strength Aluminum Alloys", Properties Related to Fracture Toughness, ASTM STP605, American Society for Testing and Materials, 1976, pp. 71–103, shows generally that for AA2024 sheet, toughness decreases as strength increases. Also, in the same paper, it will be observed that the same is true of AA7050 plate. More desirable alloys would permit increased strength with only minimal or no decrease in toughness or would permit processing steps wherein the toughness was controlled as the strength was increased in order to provide a more desirable combination of strength and toughness. Additionally, in more desirable alloys, the combination of strength and toughness would be attainable in an aluminum-lithium alloy having density reductions in the order of 5 to 15%. Such alloys would find widespread use in the aerospace industry where low weight and high strength and toughness translate to high fuel savings. Thus, it will be appreciated that obtaining qualities such as high strength at little or no sacrifice in toughness, or where toughness can be controlled as the strength is increased would result in a remarkably unique aluminum-lithium alloy product.

The present invention solves problems which limited the use of these alloys and provides an improved lithium containing aluminum base alloy product which can be processed to provide an isotropic texture or structure and to improve strength characteristics while retaining high toughness properties or which can be processed to provide a desired strength at a controlled level of toughness.

SUMMARY OF THE INVENTION

An object of this invention is to provide an aluminum lithium alloy product and thermomechanical process for providing the same which results in an isotropic structure.

A further object of this invention is to provide a thermomechanical process and alloy which greatly improves properties of aluminum-lithium alloys in the 45° direction without detrimentally affecting properties in the other directions.

A principal object of this invention is to provide an improved lithium containing aluminum base alloy product.

Another object of this invention is to provide an improved aluminum-lithium alloy wrought product having improved strength and toughness characteristics.

And yet another object of this invention includes a method of providing a wrought aluminum-lithium alloy product and working the product after solution heat treating to increase strength properties without substantially impairing its fracture toughness.

And yet a further object of this invention is to provide a method of increasing the strength of a wrought aluminum-lithium alloy product after solution heat treating without substantially decreasing fracture toughness.

These and other objects will become apparent from the specification, drawings and claims appended hereto.

In accordance with these objects, there is disclosed a method of making lithium containing aluminum base alloy products having improved properties particularly in the short transverse and 45° direction. The product comprises 0.2 to 5.0 wt. % Li, 0.05 to 6.0 wt. % Mg, at least 2.45 wt. % Cu, 0.1 to 1.0 wt. % Mn, 0.05 to 12 wt. % Zn, 0.5 wt. % max. Fe, 0.5 wt. % max. Si, the balance aluminum and incidental impurities. The method of making the product comprising the steps of providing a body of a lithium containing aluminum base alloy and heating the body to a temperature for a series of low temperature hot working operations to put the body in condition for recrystallization. The low temperature hot working operations may be used to provide an intermediate product. Thereafter, the intermediate product is recrystallized and then hot worked to a final shaped product. Alternatively, when it is desired to provide a recrystallized sheet product having elongated shaped grains, the intermediate may be cold rolled to a final gauge to provide said elongated recrystallized grains. In order to maintain such grains, the cold rolled product may require intermediate anneals. After hot rolling, the product has a metallurgical structure generally lacking intense work texture characteristics. That is, the structure is isotropic in nature and exhibits improved properties in the 45° and short transverse directions, for example. The final shaped product is solution heat treated, quenched and aged and can be provided in a recrystallized or non-recrystallized product.

DETAILED DESCRIPTION OF THE PREFERRED EMBODIMENTS

Figure 2:
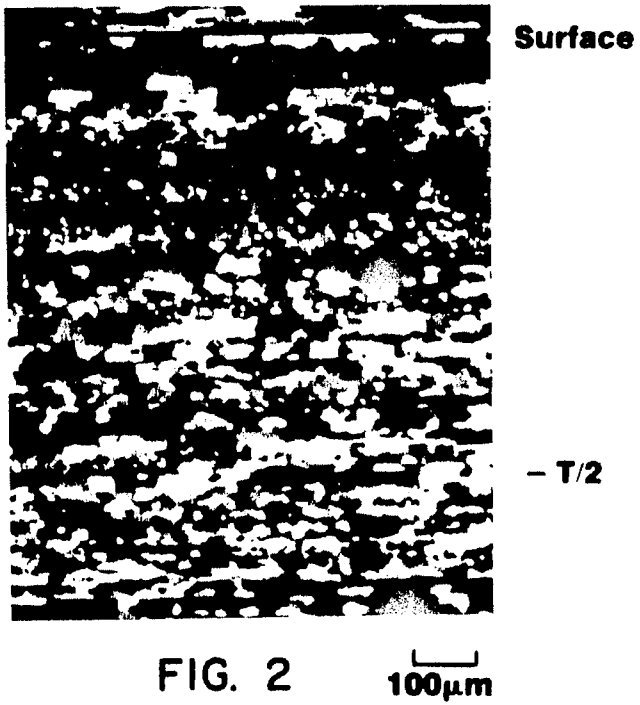
FIG. 2 shows recrystallized metallurgical structures of the alloy of Example IV.
Figure 1:
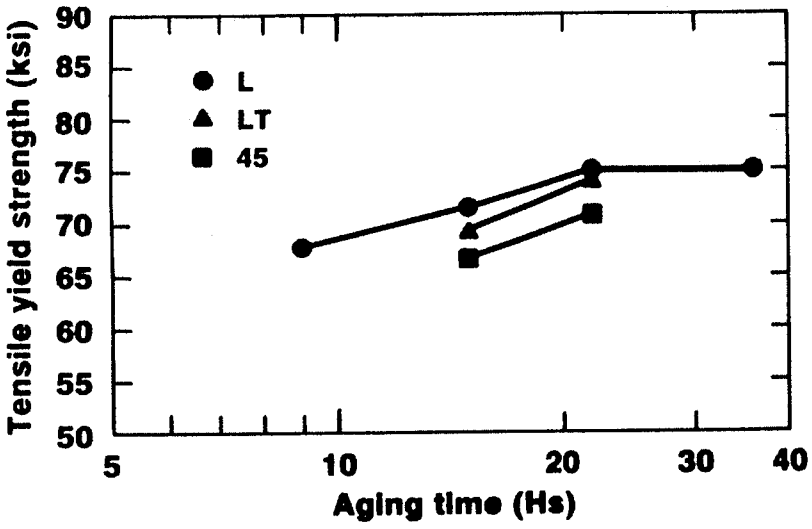
FIG. 1 is a graph showing isotropic nature of the properties of a sheet product having the composition of Example IV processed in accordance with the invention.

The alloy of the present invention can contain 0.5 to 4.0 wt. % Li, 0 to 5.0 wt. % Mg, up to 5.0 wt. % Cu, 0 to 1.0 wt. % Zr, 0 to 2.0 wt. % Mn, 0 to 9.0 wt. % Zn, 0.5 wt. % max. Fe, 0.5 wt. % max. Si, the balance aluminum and incidental impurities. The impurities are preferably limited to about 0.25 wt. % each, and the combination of impurities preferably should not exceed 0.5 wt. %. Within these limits, it is preferred that the sum total of all impurities does not exceed 0.5 wt. %.

Preferably, the alloy of the present invention contains 0.2 to 5.0 wt. % Li, 0.5 to 6.0 wt. % Mg, at least 2.45 wt. % Cu, 0.05 to 12 wt. % Zn, 0.1 to 1.0 wt. % Mn, 0.1 wt. % max. Zr, 0.5 wt. % max. Fe, 0.5 wt. % max. Si, the balance aluminum and incidental impurities.

Typically, an alloy in accordance with the present invention can contain 1.5 to 3.0 wt. % Li, 2.5 to 5.0 wt. % Cu, 0.2 to 2.5 wt. % Mg, 0.2 to 11 wt. % Zn, 0.1 to 0.8 wt. % Mn, the balance aluminum and impurities as specified above. A typical alloy composition would contain 1.8 to 2.5 wt. % Li, 2.55 to 2.9 wt. % Cu, 0.2 to 2.0 wt. % Mg, 0.2 to 2.0 wt. % Zn, 0.1 to 0.7 wt. % Mn, and max. 0.15 wt. % Zr, and max. 0.3 wt. % each of Fe and Si.

A suitable alloy composition would contain 1.9 to 2.4 wt. % Li, 2.55 to 2.9 wt. % Cu, 0.1 to 0.6 wt. % Mg, 0.5 to 1.0 wt. % Zn, 0.1 to 0.7 wt. % Mn, max. 0.15 wt. % Zr, and max. 0.25 wt. % of each of Fe and Si, the remainder aluminum.

In the present invention, lithium is very important not only because it permits a significant decrease in density but also because it improves tensile and yield strengths markedly as well as improving elastic modulus. Additionally, the presence of lithium improves fatigue resistance. Most significantly though, the presence of lithium in combination with other controlled amounts of alloying elements permits aluminum alloy products which can be worked to provide unique combinations of strength and fracture toughness while maintaining meaningful reductions in density. It will be appreciated that less than 0.5 wt. % Li does not provide for significant reductions in the density of the alloy and 4 wt. % Li is close to the solubility limit of lithium, depending to a significant extent on the other alloying elements. It is not presently expected that higher levels of lithium would improve the combination of toughness and strength of the alloy product.

With respect to copper, particularly in the ranges set forth hereinabove for use in accordance with the present invention, its presence enhances the properties of the alloy product by reducing the loss in fracture toughness at higher strength levels. That is, as compared to lithium, for example, in the present invention copper has the capability of providing higher combinations of toughness and strength. For example, if more additions of lithium were used to increase strength without copper, the decrease in toughness would be greater than if copper additions were used to increase strength. Thus, in the present invention when selecting an alloy, it is important in making the selection to balance both the toughness and strength desired, since both elements work together to provide toughness and strength uniquely in accordance with the present invention. It is important that the ranges referred to hereinabove, be adhered to, particularly with respect to the upper limits of copper, since excessive amounts can lead to the undesirable formation of intermetallics which can interfere with fracture toughness.

Magnesium is added or provided in this class of aluminum alloys mainly for purposes of increasing strength although it does decrease density slightly and is advantageous from that standpoint. It is important to adhere to the upper limits set forth for magnesium because excess magnesium can also lead to interference with fracture toughness, particularly through the formation of undesirable phases at grain boundaries.

Manganese is the preferred material for grain structure control and can be present up to 2.0 wt. %, with a preferred amount being in the range of 0.1 to 1.0 wt. %; however, other grain structure control materials can include Cr, V, Hf, Zr, Ti and Sc, typically in the range of 0.01 to 0.2 wt. % with Hf up to typically 0.6 wt. %. The level of Zr used depends on whether a recrystallized or unrecrystallized structure is desired. The use of zinc results in increased levels of strength, particularly in combination with magnesium. However, excessive amounts of zinc can impair toughness through the formation of intermetallic phases.

Zinc is important because, in this combination with magnesium, it results in an improved level of strength which is accompanied by high levels of corrosion resistance when compared to alloys which are zinc free. Particularly effective amounts of Zn are in the range of 0.1 to 2.0 wt. % when the magnesium is in the range of 0.05 to 0.5 wt. %, as presently understood. It is important to keep the Mg and Zn in a ratio in the range of about 0.1 to less than 1.0 when Mg is in the range of 0.1 to 1 wt. % with a preferred ratio being in the range of 0.2 to 0.9 and a typical ratio being in the range of about 0.3 to 0.8. The ratio of Mg to Zn can range from 1 to 6 when the wt. % of Mg is 1 to 4.0 and Zn is controlled to 0.2 to 2.0 wt. %, preferably in the range of 0.2 to 0.9 wt. %.

Working with the Mg/Zn ratio of less than one is important in that it aids in the worked product being less anisotropic or being more isotropic in nature, i.e., properties more uniform in all directions. That is, working with the Mg/Zn ratio in the range of 0.2 to 0.8 can result in the end product having greatly reduced hot worked texture, resulting from rolling, for example, to provide improved properties, for example in the 45° direction.

The Mg/Zn ratio less than one is important for another reason. That is, keeping the Mg/Zn ratio less than one, e.g., 0.5, results not only in greatly improved strength and fracture toughness but in greatly improved corrosion resistance. For example, when the Mg and Zn content is 0.5 wt. % each, the resistance to corrosion is greatly lowered. However, when the Mg content is about 0.3 wt. % and the Zn is 0.5 wt. %, the alloys have a high level of resistance to corrosion.

The amount of manganese should also be closely controlled. Manganese is added to contribute to grain structure control, particularly in the final product. Manganese is also a dispersoid-forming element and is precipitated in small particle form by thermal treatments and has as one of its benefits a strengthening effect. Dispersoids such as $Al_{20}Cu_2Mn_3$ and $Al_{12}Mg_2Mn$ can be formed by manganese. Chromium can also be used for grain structure control but on a less preferred basis. The use of zinc results in increased levels of strength, particularly in combination with magnesium. However, excessive amounts of zinc can impair toughness through the formation of intermetallic phases.

Toughness or fracture toughness as used herein refers to the resistance of a body, e.g. extrusions, forgings, sheet or plate, to the unstable growth of cracks or other flaws.

While the inventors do not wish to be held to any theory of invention, it is believed that the resistance to exfoliation and the resistance to crack propagation under an applied stress increases as Zn is added. It is believed that this behavior is due to the fact that Zn stimulates the desaturation of Cu from the matrix solid solution by enhancing the precipitation of Cu-rich precipitates. This effect is believed to change the solution potential to higher electronegative values. It is also believed that Zn forms Mg-Zn bearing phases at the grain boundaries that interact with propagating cracks and blunt the crack tip or deflect the advancing crack and thereby improves the resistance to crack propagation under an applied load.

As well as providing the alloy product with controlled amounts of alloying elements as described hereinabove, it is preferred that the alloy be prepared according to specific method steps in order to provide the most desirable characteristics of both strength and fracture toughness. Thus, the alloy as described herein can be provided as an ingot or billet for fabrication into a suitable wrought product by casting techniques currently employed in the art for cast products, with continuous casting being preferred. Further, the alloy may be roll cast or slab cast to thicknesses from about 0.10 to 2 or 3 inches or more depending on the end product desired. It should be noted that the alloy may also be provided in billet form consolidated from fine particulate such as powdered aluminum alloy having the compositions in the ranges set forth hereinabove. The powder or particulate material can be produced by processes such as atomization, mechanical alloying and melt spinning. The ingot or billet may be preliminarily worked or shaped to provide suitable stock for subsequent working operations. Prior to the principal working operation, the alloy stock is preferably subjected to homogenization, and preferably at metal temperatures in the range of 900° to 1050° F. for a period of time of at least one hour to dissolve soluble elements such as Li, Cu, Zn and Mg and to homogenize the internal structure of the metal. A preferred time period is about 20 hours or more in the homogenization temperature range. Normally, the heat up and homogenizing treatment does not have to extend for more than 40 hours; however, longer times are not normally detrimental. A time of 20 to 40 hours at the homogenization temperature has been found quite suitable.

After the homogenizing treatment, the metal can be rolled or extruded or otherwise subjected to working operations to produce stock such as sheet, plate or extrusions or other stock suitable for shaping into the end product. To produce a sheet or plate-type product, a body of the alloy is preferably hot rolled to a thickness ranging from 0.1 to 0.25 inch for sheet and 0.25 to 6.0 inches for plate. For hot rolling purposes, the temperature should be in the range of 1000° F. down to 750° F.. Preferably, the metal temperature initially is in the range of 850° to 975° F..

When the intended use of a plate product is for wing spars where thicker sections are used, normally operations other than hot rolling are unnecessary. Where the intended use is wing or body panels requiring a thinner gauge, further reductions as by cold rolling can be provided Such reductions can be to a sheet thickness ranging, for example, from 0.010 to 0.249 inch and usually from 0.030 to 0.16 inch.

After working a body of the alloy to the desired thickness, the sheet or plate or other worked article is subjected to a solution heat treatment to dissolve soluble elements. The solution heat treatment is preferably accomplished at a temperature in the range of 900° to 1050° F. and preferably produces an unrecrystallized grain structure for plate and a recrystallized grain structure for sheet.

In the present invention, short transverse properties, e.g., ahort transverse toughness, can be improved by carefully controlled thermal and mechanical operations in combination with alloying of the lithium-containing aluminum base alloy. Accordingly, for purposes of improving the short transverse properties, e.g. toughness and ductility in the short transverse direction, the zirconium content of lithium-containing aluminum base alloy should be maintained in the range of 0 to 0.15 wt. %. Preferably, zirconium is in the range of 0.01 to 0.12 wt. %, with a typical amount being in the range of 0.01 to 0.1 wt. %. Other elements, e.g. chromium, cerium (0.01 to 0.5 wt. %), hafnium, vanadium, manganese, scandium (0.01 to 0.2 wt. %), capable of forming fine dispersoids which retard grain boundary migration and having a similar effect in the process as zirconium, may be used. The amount of these other elements may be varied, however, to produce the same effect as zirconium, the amount of any of these permit recrystallization of an intermediate product, yet the amount should be high enough to retard recrystallization during solution heat treating if a non-recrystallized product, e.g., plate product, is desired. If a recrystallized product, e.g., sheet product, is desired, then these elements should be kept low.

For purposes of illustrating the invention, an ingot of the alloy is heated prior to an initial hot working operation. This temperature should be controlled so that a substantial amount of grain boundary precipitate, i.e., particles present at the original dendritic boundaries, not be dissolved. That is, if a higher temperature is used, most of this grain boundary precipitate would be dissolved and later operations normally would not be effective. If the temperature is too low, then the ingot will not deform without cracking. Thus, preferably, the ingot or working stock should be heated to a temperature in the range of 600° to 950° F., and more preferably 700° to 900° F. with a typical temperature being in the range of 800° to 870° F. This step may be referred to as a low temperature preheat.

If it is desired, the ingot may be homogenized prior to this low temperature preheat without adversely affecting the end product. However, as presently understood, the preheat may be used without the prior homogenization step at no sacrifice in properties.

After the ingot has been heated to this condition, it is hot/warm worked or hot/warm rolled to provide an intermediate product. That is, once the ingot has reached the low temperature preheat, it is ready for the next operation. However, longer times at the preheat temperature are not detrimental. For example, the ingot may be held at the preheat temperature for up to 20 or 30 hours; but, for purposes of the present invention, times less than 1 hour, for example, can be sufficient. If the ingot were being rolled into plate as a final product, then this initial hot working can reduce the ingot 1.5 to 15 times that of the plate. A preferred reduction is 1.5 to 5 times that of the plate with a typical reduction being two to three times the thickness of the final plate thickness. The preliminary hot working may be initiated in the temperature range of the low temperature preheat. However, this preliminary hot working can be carried out in the temperature range of 1000° to 400° F. While this working step has been referred to as hot working, it may be more conveniently referred to as low temperature hot working or warm working for purposes of the present invention. Further, it should be understood that the same or similar effects may be obtained with a series or variation of temperature preheat steps and low temperature hot working steps, singly or combined, and such is contemplated within the present invention.

After this initial low temperature hot working step, the intermediate product is then heated to a temperature sufficiently high to recrystallize its grain structure. For purposes of recrystallization, the temperature can be in the range of 900° to 1040° F. with a preferred recrystallization temperature being 980° to 1020° F. It is the recrystallization step, particularly in conjunction with the earlier steps, which permits the improvement in short transverse properties of plate, for example, fabricated in accordance with the present invention. If too much zirconium is present, then recrystallization will not occur. By the use of the word recrystallization is meant to include partial recrystallization as well as complete recrystallization.

After recrystallization, the intermediate product is further hot worked or hot rolled to a final product shape. As noted earlier, to produce a sheet or plate-type product, the intermediate product is hot rolled to a thickness ranging from 0.1 to 0.25 inch for sheet and 0.25 to 10.0 inches for plate, for example. For this final hot working operation, the temperature should be in the range of 1020° to 750° F., and preferably initially the metal temperature should be in the range of 900 to 1000° F. With respect to this last hot working step, it is important that the temperatures be carefully controlled.

In order to obtain improved short transverse properties, solution heat treating is performed as noted before, and care must be taken to ensure a substantially unrecrystallized grain structure for plate, for example. Thus, the alloy in accordance with the invention must contain a minimum level of zirconium and/or manganese to retard recrystallization of the final product during solution heat treating. In addition, it is for the same reason that care must be taken during the final hot working step to guard against using too low temperatures and its attendant problems. That is, unduly high amounts of work being added in the final hot working step can result in recrystallization of the final product during solution heat treating and thus should be avoided.

If it is desired to produce a sheet product having high resistance to both exfoliation and stress corrosion cracking, the intermediate product may be cold rolled to sheet gauge after the recrystallization step. By cold rolling as used herein is meant to include rolling at low temperatures, e.g., 100° to 300° F. or ambient temperature. This has the effect of elongating the grains formed during the recrystallization step. It is elongated grains which can provide the high resistance to both exfoliation corrosion and stress corrosion cracking. These grains can have an aspect ratio of 1.5 to 20, preferably 2 to 10. In order to form the elongated grains, it may be necessary to have several cold rolling passes with intermediate anneals. Further, in order to maintain the elongated grains, care is required in reaching the solution heat treating temperature to avoid the grains reverting to their original configuration. Thus, after cold rolling, the sheet product may be subjected to a stepped anneal where it is first heated up to 750° to 800° F. and then over a period, e.g., ½ to 30 hours, 2° to 200° F./hr, typically 10° to 15° F./hr heated to about 900° F. prior to heating to solution heat treating temperatures.

If it is required that the end product be less anisotropic or more isotropic in nature, i.e., properties more or less uniform in all directions, then the low temperature hot working operation can require further control. That is, if the end product is required to be substantially free or generally lacking an intense worked texture so as to improve properties in the 45° direction, then the low temperature hot working operations can be carried out so as to attain such characteristic. For example, to improve 45° properties, a step low temperature hot working operation can be employed where the working operation and the temperature is controlled for a series of steps. Thus, in one embodiment of this operation, after the low temperature preheat, the ingot is reduced by about 5 to 35% of thickness of the original ingot in the first step of the low temperature hot working operation with preferred reductions being in the order of 10 to 25% of the thickness. The temperature for this first step should be in the range of about 665° to 925° F. In the second step of the operation, the reduction is in the order of 20 to 50% of the thickness of the material from the first step with typical reductions being about 25 to 35%. The temperature in the second step should not be greater than 660° F. and preferably is in the range of 500° to 650° F. In the third step, the reduction should be 20 to 40% of the thickness of the material from the second step, and the temperature should be in the range of 350° to 500° F. with a typical temperature being in the range of 400° to 475° F. These steps provide an intermediate product which is recrystallized, as noted earlier. A typical recrystallized structure of the intermediate product is shown in FIG. 2. For convenience of the present invention, the low temperature preheat, low temperature hot working coupled with temperature control and the recrystallization of the intermediate product are referred to herein as a recrystallization effect which, in accordance with the present invention, makes it possible to moderate the anisotropy of the mechanical characteristics, and if desired, produce a final product isotropic in nature. While this embodiment of the invention has been illustrated by referring to a three-step process, it will be noted that the scope of the invention is not necessarily limited thereto. For example, there can be a number of low temperature hot working operations that may be employed to control anisotropy depending on which property is desired, and this is now attainable as a result of the teachings herein, particularly utilizing the low temperature hot working operations and recrystallization of an intermediate product. The control can be even more effective if combined with small variations in composition of the aluminum-lithium alloys. For example, a two-step low temperature hot working operation may be employed. It is believed that in the three-step process, the last two steps of low temperature hot working are more important in producing the desired microstructure in the intermediate product. Or, the temperature direction may be reversed for each step, or combinations of low and high temperatures may be used during the low temperature hot working operations. These illustrations are not necessarily intended to limit the scope of the invention but are set forth as illustrative of the new process and aluminum-lithium products which may be attained as a result of the new processes disclosed herein.

To further provide for the desired strength and fracture toughness, as well as corrosion resistance, necessary to the final product and to the operations in forming that product, the product should be quenched to prevent or minimize uncontrolled precipitation of strengthening phases referred to herein later.

Thus, it is preferred in the practice of the present invention that the quenching rate be at least 100° F. per second from solution temperature to a temperature of about 200° F. or lower. A preferred quenching rate is at least 200° F. per second in the temperature range of 900° F. or more to 200° F. or less. After the metal has reached a temperature of about 200° F., it may then be air cooled. When the alloy of the invention is slab cast or roll cast, for example, it may be possible to omit some of the steps referred to hereinabove, and such is contemplated within the purview of the invention.

After the alloy product of the present invention has been quenched, it may be artificially aged to provide the combination of fracture toughness and strength which are so highly desired in aircraft members. This can be accomplished by subjecting the sheet or plate or shaped product to a temperature in the range of 150° to 400° F. for a sufficient period of time to further increase the yield strength. Some compositions of the product are capable of being artificially aged to a yield strength as high as 95 ksi. However, the useful strengths are in the range of 50 to 85 ksi and corresponding fracture toughnesses for plate products are in the range of 15 to 75 ksi in. Preferably, artificial aging is accomplished by subjecting the alloy product to a temperature in the range of 250° to 375° F. for a period of at least 30 minutes. A suitable aging practice contemplate a treatment of about 8 to 24 hours at a temperature of about 325° F. Further, it will be noted that the alloy product in accordance with the present invention may be subjected to any of the typical underaging treatments well known in the art, including natural aging and multi-step agings. Also, while reference has been made herein to single aging steps, multiple aging steps, such as two or three aging steps, are contemplated and stretching or its equivalent working may be used prior to or even after part of such multiple aging steps.

Specific strength, as used herein, is the tensile yield strength divided by the density of the alloy. Plate products, for example, made from alloys in accordance with the invention, have a specific strength of at least $0.75\times10^6$ ksi in$^3$/lb and preferably at least $0.80\times10^6$ ksi in$^3$/lb. The alloys have the capability of producing specific strengths as high as $1.00\times10^6$ ksi in$^3$/lb.

The wrought product in accordance with the invention can be provided either in a recrystallized grain structure form or an unrecrystallized grain structure form, depending on the type of thermomechanical processing used. When it is desired to have an unrecrystallized grain structure plate product, the alloy is hot rolled and solution heat treated, as mentioned earlier. If it is desired to provide a recrystallized plate product, then the Zr is kept to a very low level, e.g., less than 0.08 wt. %; however, other elements, e.g., Mn, etc., must be present as noted herein, and the thermomechanical processing is carried out at rolling temperatures of about 800° to 850° F. with the solution heat treatment as noted above. For unrecrystallized grain structure, Zr should be above 0.10 wt. % and the thermomechanical processing is as above except a heat-up rate of not greater than 5° F./min and preferably less than 1° F./min is used in solution heat treatment.

If recrystallized sheet is desired having low Zr, e.g., less than 0.1 wt. %, typically in the range of 0.05 to 0.08 Zr, the ingot is first hot rolled to slab gauge of about 2 to 5 inches as above. Thereafter, it is reheated to between 700° to 850° F. then hot rolled to sheet gauge. This is followed by an anneal at between 500° to 900° F. for 1 to 12 hours. The material is then cold rolled to provide at least a 25% reduction in thickness to provide a sheet product. The sheet is then solution heat treated, quenched, stretched and aged as noted earlier. Where the Zr or Mn content is fairly substantial, such as about 0.12 wt. % or 0.4 wt. % Mn, a recrystallized grain structure can be obtained if desired. Here, the ingot is hot rolled at a temperature in the range of 800° to 1000° F. and then annealed at a temperature of about 800° to 850° F. for about 4 to 16 hours. Thereafter, it is cold rolled to achieve a reduction of at least 25% in gauge. The sheet is then solution heat treated at a temperature in the range of 950° to 1020° F. using heat-up rates of not slower than about 10° F./min with typical heat-up rates being as fast as 200° F./min with faster heat-up rates giving finer recrystallized grain structure. The sheet may then be quenched, stretched and aged.

Wrought products, e.g., sheet, plate and forgings, in accordance with the present invention develop a solid state precipitate along the (100) family of planes. The precipitate is plate like and has a diameter in the range of about 50 to 100 Angstroms and a thickness of 4 to 20 Angstroms. The precipitate is primarily copper or copper-magnesium containing; that is, it is copper or copper-magnesium rich. These precipitates are generally referred to as GP zones and are referred to in a paper entitled "The Early Stages of GP Zone Formation in Naturally Aged Al-4 Wt Pct Cu Alloys" by R. J. Rioja and D. E. Laughlin, *Metallurgical Transactions A,* Vol. 8A, August 1977, pp. 1257–61, incorporated herein by reference. It is believed that the precipitation of GP zones results from the addition of Mg and Zn which is believed to reduce solubility of Cu in the Al matrix. Further, it is believed that the Mg and Zn stimulate nucleation of this metastable strengthening precipitate. The number density of precipitates on the (100) planes per cubic centimeter ranges from $1\times10^{15}$ to $1\times10^{17}$ with a preferred range being higher than $1\times10^{15}$ and typically as high as $5\times10^{16}$. These precipitates aid in producing a high level of strength without losing fracture toughness, particularly if short aging times, e.g., 15 hours at 350° F., are used for unstretched products.

Extrusions and forgings are typically prepared by hot working at temperatures in the range of 600° to 1000° F., depending to some extent on the properties and microstructures desired.

The following examples are further illustrative of the invention.

EXAMPLE I

For comparison purposes, an aluminum alloy consisting of, by weight percent, 2.4 Li, 2.7 Cu, 0.12 Zr (AA2090), the balance being essentially aluminum and impurities, was cast into an ingot suitable for rolling. The ingot was homogenized in a furnace at a temperature of 950° F. for 8 hours followed immediately by a temperature of 1000° F. for 24 hours and air cooled. The ingot was then preheated in a furnace for 30 minutes at 975° F. and hot rolled to 4 inch thick slab. The slab was reheated for 30 minutes at 975° F. and hot rolled to 1.5 and 0.5 inch plate. Prior to solution heat treatment, the plate was annealed for 24 hours in a furnace at 800° F. followed by a solution heat treatment of 2 hours at 1020° F. and a continuous water spray quench with a water temperature of 72° F. The plate was stretched in the rolling direction with a 6% permanent set. Stretching was followed with an artificial aging treatment of 24 hours at 325° F. Tensile properties were determined in accordance with ASTM B-557. Tensile samples through thickness were 0.064 inch thick in the longitudinal direction. Fracture toughness measurements were obtained using compact tension fracture toughness samples in accordance with ASTM E-399 and B645. Results from mechanical properties are shown in Table I. All properties in Table I were obtained from the 0.5 inch plate except for the short transverse properties which were obtained from the 1.5 inch plate. The strength at the middle of the plate (Thickness/2) is significantly higher than the strength close to the surface (Thickness/10) or midway between surface and center (Thickness/4).

X-ray pole figures from the 0.5 inch plate revealed the presence of a well defined rolling texture. In addition to the above, there is a large difference in strength among the longitudinal and short transverse directions and the low fracture toughness in the short transverse direction. This lack of uniformity in mechanical properties in different directions has led to the rejection of a number of Al-Li products in commercial applications.

TABLE I

| Direction | TYS (ksi) | UTS (ksi) | % El. | Toughness ksi sq.rt (in) |
|---|---|---|---|---|
| L (T/2) | 81.0 | 85.0 | 6.8 | 34.0 (L-T) |
| LT (T/2) | 79.0 | 84.0 | 4.5 | 27.0 (T-L) |
| 45 (T/2) | 68.0 | 76.0 | 4.5 | |
| ST | 64.0 | 70.0 | 1.1 | 7.0 (S-L) |
| L (T/4) | 67.5 | 72.3 | 7.0 | |
| L (T/10) | 63.9 | 65.3 | 5.0 | |

EXAMPLE II

For comparison purposes, an aluminum alloy consisting of, by weight percent, 2.2 Li, 2.7 Cu, 0.11 Zr (AA2090), the balance being essentially aluminum and impurities, was cast into an ingot suitable for rolling. The ingot was homogenized in a furnace at a temperature of 950° F. for 8 hours followed immediately by a temperature of 1000° F. for 24 hours and air cooled. The ingot was then preheated in a furnace for 30 minutes at 850° F. and hot rolled to 3 inch thick slab. The slab was reheated for 8 hours at 1000° F. for recrystallization purposes and hot rolled to 1.5 inch plate. Prior to solution heat treatment, the plate was annealed for 24 hours in a furnace at 800° F. followed by a solution heat treatment of 2 hours at 1020° F. and a continuous water spray quench with a water temperature of 72° F. The plate was stretched in the rolling direction with a 6% permanent set. Stretching was followed with an artificial aging treatment of 24 hours at 325° F. Tensile properties were determined in accordance with ASTM B-557. Tensile samples through thickness were 0.064 inch thick in the longitudinal direction. Fracture toughness measurements were obtained using compact tension fracture toughness samples in accordance with ASTM E-399 and B-645. Results from mechanical properties are shown in Table II. Note that the difference in longitudinal strength through the thickness of plate is not as large as in the previous example; that is, the strength at the middle of the plate (Thickness/2) is about the same as the strength close to the surface (Thickness/10) or midway between surface and center (Thickness/4).

X-ray pole figures from the plate revealed that the rolling texture was not as pronounced as in Example I. Despite the improvement in uniformity of strength through thickness, note in Table II that the fracture toughness in the short transverse direction is still low.

TABLE II

| Direction | TYS (ksi) | UTS (ksi) | % El. | Toughness ksi sq.rt (in) |
|---|---|---|---|---|
| L (T/2) | 76.2 | 79.8 | 3.0 | 36.8 (L-T) |
| LT (T/2) | 74.9 | 79.2 | 2.0 | 23.6 (T-L) |
| 45 (T/2) | 68.2 | 76.2 | 3.0 | |
| ST | 60.1 | * | * | 7.9 (S-L) |
| L (T/4) | 73.0 | 79.2 | 2.0 | |
| L (T/10) | 75.8 | 80.7 | 3.5 | |

*specimens broke during testing.

EXAMPLE III

An aluminum alloy in accordance with the invention consisting of, by weight percent, 2.0 Li, 2.5 Cu, 1.0 Zn, 0.3 Mg, 0.4 Mn, 0.02 Zr, the balance being essentially aluminum and impurities, was cast into an ingot suitable for rolling. The ingot was homogenized in a furnace at a temperature of 950° F. for 8 hours followed immediately by a temperature of 1000° F. for 24 hours and air cooled. The ingot was then preheated in a furnace for 30 minutes at 900° F. and hot rolled to 3.5 inch thick slab. The slab was reheated for 4 hours at 1000° F. for recrystallization purposes and hot rolled to 1.5 inch plate. The plate was then solution heat treated for 2 hours at 1020° F. and quenched in a continuous water spray quench with a water temperature of 72° F. The plate was stretched in the rolling direction with a 6% permanent set after one day of natural aging. Stretching was followed with an artificial aging treatment of 36 hours at 310° F. Tensile properties were determined in accordance with ASTM B-557. Tensile samples through thickness were 0.064 inch thick in the longitudinal direction. Fracture toughness measurements were obtained using compact tension fracture toughness samples in accordance with ASTM E-399 and B-645. Results from mechanical properties are shown in Table III. Note that the large difference in longitudinal strength through the thickness of plate, as shown in Example I, was reduced; that is, the strength at the middle of the plate (Thickness/2) is similar to the strength midway between surface and center (Thickness/4).

X-ray pole figures failed to reveal the presence of a well defined rolling texture. In addition to the above, note that the fracture toughness in the short transverse direction is significantly higher than in the previous two examples.

TABLE III

| Direction | TYS (ksi) | UTS (ksi) | % El. | Toughness ksi sq.rt (in) |
|---|---|---|---|---|
| L (T/2) | 73.7 | 76.6 | 2.0 | 35.0 (L-T) |
| LT (T/2) | 71.1 | 74.8 | 2.0 | 25.7 (T-L) |
| 45 (T/2) | 67.9 | 72.3 | 2.0 | |
| ST | 64.3 | 71.3 | 1.1 | 16.7 (S-L) |
| L (T/4) | 70.2 | 75.3 | 2.0 | |

EXAMPLE IV

An aluminum alloy in accordance with the invention consisting of, by weight percent, 2.0 Li, 2.7 Cu, 0.08 Zr, 0.3 Mg, 1.0 Zn, 0.4 Mn, 0.01 V, the balance being essentially aluminum and impurities, was cast into an ingot suitable for rolling into a sheet product. The ingot was homogenized in a furnace at a temperature of 950° F. for 8 hours followed immediately by a temperature of 1000° F. for 24 hours and air cooled. The ingot was then preheated in a furnace for 30 minutes at 975° F. and hot rolled to 3.5 inch thick slab. The slab was heated to 975° F. for 2 hours for recrystallization purposes and finished hot rolling to 0.162 inch gauge sheet which was given an anneal at 850° F. for 2 hours followed by furnace cool to 400° F. The sheet was then cold rolled to 0.090 inch and solution heat treated at 1000° F. for 30 minutes. Quenching took place via immersion in water at room temperature.

The sheet was cold rolled 2% after quench and given a 1% stretch in the rolling direction. Stretching was followed with an artificial aging treatment of 22 hours at 310° F. Tensile properties were determined in accordance with ASTM B-557. Fracture toughness was measured from 0.090×16×44 inches specimens with fatigue pre-cracked center slot in accordance with ASTM B-646 and E-561. Results from mechanical properties are shown in Table VII. FIG. 2 shows the strengthening response during aging at 310° F.

FIG. 2 shows the recrystallized microstructure of the sheet product resulting from the above fabrication practice.

TABLE VII

| Direction | TYS (ksi) | UTS (ksi) | % El. | Toughness ksi sq.rt (in) |
|---|---|---|---|---|
| L | 75.0 | 79.8 | 5.0 | 49.9 (L-T) |
| LT | 74.0 | 80.7 | 4.0 | |
| 45 degree | 70.8 | 79.2 | 5.0 | |

It will be seen from the above data that even in a sheet product there is very little difference in the longitudinal and 45° strengths. In fabrication by conventional practices, much greater differences are encountered. Thus, it will be seen that the present invention provides very uniform properties.

While the invention has been described in terms of preferred embodiments, the claims appended hereto are intended to encompass other embodiments which fall within the spirit of the invention.

What s claimed is:

1. A method of making lithium containing aluminum base flat rolled products having improved corrosion resistance and having improved toughness properties for plate and improved anisotropy for sheet, the method comprising the steps of:

(a) providing a body of aluminum base alloy consisting essentially of 0.2 to 5.0 wt. % Li, 0.05 to 6.0 wt. % Mg, at least 2.45 wt. % Cu, 0.1 to 1.0 wt. % Mn, 0.05 to 6.0 wt. % Zn, 0.5 wt. % max. Fe, 0.5 wt. % max. Si, at least one of the elements selected from the group Cr, V, Hf, Zr, Ti, Sc and Ce with Cr, V, Zr, Ti and Sc in the range of 0.01 to 0.2 wt. %, Hf up to 0.6 wt. % and Ce in the range of 0.01 to 0.5 wt. %, Mg and Zn maintained in a ratio in the range of 0.1 to less than 1, the balance aluminum and incidental impurities;

(b) bringing the body to a temperature for at least one low temperature hot working operation to put said body in a condition for recrystallization;

(c) subjecting said body to at least one controlled low temperature hot working operation to provide an intermediate product;

(d) recrystallizing said intermediate product;

(e) hot working the recrystallized product; and (f) solution heat treating, quenching and aging said recrystallized and hot worked product to provide a product having a metallurgical structure generally lacking intense work texture characteristics, the product having said improved level of properties.

2. The method in accordance with claim 1 wherein in step (c), the hot working operation includes a series of controlled low temperature hot working operations.

3. The method in accordance with claim 2 wherein the series includes at least two low temperature hot working steps.

4. The method in accordance with claim 3 wherein the first low temperature hot working operation is performed at a temperature higher than the second low temperature hot working step.

5. The method in accordance with claim 2 wherein the series includes three steps of low temperature hot working operations.

6. The method in accordance with claim 2 wherein one operation in the series of the low temperature hot working operations is performed at a temperature in the range of 665° to 925° F.

7. The method in accordance with claim 2 wherein one operation in the series of the low temperature hot working operations is performed at a temperature in the range of 500° to 700° F.

8. The method in accordance with claim 2 wherein one operation in the series of the low temperature hot working operations is performed at a temperature in the range of 350° to 500° F.

9. The method in accordance with claim 2 wherein the low temperature hot working operations include two steps, one of which is performed at a temperature in the range of 665° to 925° F. and one which is performed at a temperature in the range of 350° to 650° F.

10. The method in accordance with claim 2 wherein the series of low temperature operations include three steps, one of which is performed at a temperature in the range of 665° to 925° F., a second which is performed at a temperature in the range of 500° to 700° F. and a third which is performed at a temperature in the range of 350 to 500.

11. The method in accordance with claim 10 wherein the high temperature step of the low temperature hot working operations is performed first.

12. The method in accordance with claim 10 wherein the low temperature step of the low temperature hot working operations is performed last.

13. The method in accordance with claim 1 wherein in step (b) thereof the body is heated to a temperature in the range of 600° to 900° F.

14. The method in accordance with claim 1 wherein in step (b) thereof the body is heated to a temperature in the range of 700° to 900° F.

15. The method in accordance with claim 1 wherein said body is subjected to homogenization prior to heating said body as set forth in claim 1(b).

16. The method in accordance with claim 1 wherein recrystallization is carried out at a temperature in the range of 900° to 1040° F.

17. The method in accordance with claim 1 wherein recrystallization is carried out at a temperature in the range of 980° to 1020° F.

18. The method in accordance with claim 1 wherein the intermediate product is at least partially recrystallized.

19. The method in accordance with claim 1 wherein the hot working of the recrystallized product is carried out at a temperature in the range of 900° to 1040° F.

20. The method in accordance with claim 1 wherein the hot working of the recrystallized product is carried out at a temperature in the range of 950° to 1020° F.

21. The method in accordance with claim 1 including solution heat treating at a temperature in the range of 900° to 1050° F.

22. The method in accordance with claim 1 wherein the recrystallized and hot worked product is artificially aged at a temperature in the range of 150° to 400° F.

23. The method in accordance with claim 22 wherein the intermediate product is a flat rolled product having a thickness of 1.5 to 15 times the final product.

24. The method in accordance with claim 1 wherein the alloy is consisting of 1.5 to 3.0 wt. % Li, 0.2 to 2.5 wt. % Mg, 0.2 to 2.0 wt. % Zn, 2.55 to 2.90 wt. % Cu and 0.1 to 0.8 wt. % Mn.

25. The method in accordance with claim 1 wherein said body is an ingot and one step in said series of low temperature hot working operations reduces the thickness of the ingot by 5 to 25%.

26. An aluminum base alloy suitable for forming into a wrought product having improved combinations of strength and fracture toughness, the alloy consisting of 1.8 to 2.5 wt. % Li, 0.2 to 2.0 wt. % Mg, 2.5 to 2.9 wt. % Cu, 0.1 to 0.7 wt. % Mn, 0.2 to 2.0 wt. % Zn, 0.5 wt. % max. Fe, 0.5 wt. % max. Si, Mg and Zn maintained in a ratio of 0.1 to 1, the balance aluminum and incidental impurities.

27. The method in accordance with claim 1 wherein said body is an ingot and one step in said series reduces the thickness by 20 to 40% of the thickness of the starting material.

28. The method in accordance with claim 1 wherein said body is an ingot and the third step in said series reduces the thickness by 20 to 30% of the thickness of the starting material.

29. The method in accordance with claim 1 wherein said recrystallized and hot worked product is substantially unrecrystallized.

30. The method in accordance with claim 29 wherein said recrystallized and hot worked product is a recrystallized product.

31. A method of making lithium containing aluminum base flat rolled products having improved corrosion resistance and having improved toughness properties for plate and improved anisotropy for sheet, the method comprising the steps of:

(a) providing a body consisting essentially of 1.5 to 3.0 wt. % Li, 0.2 to 2.5 wt. % Mg, 2.55 to 2.90 wt. % Cu, 0.1 to 0.8 wt. % Mn, 0.2 to 2.0 wt. % Zn, 0.5 wt. % max. Fe, 0.5 wt. % max. Si, at least one of the elements selected from the group Cr, V, Hf, Zr, Ti, Sc and Ce with Cr, V, Zn, Ti, Zn and Sc in the range of 0.01 to 0.2 wt. %, Hf up to 0.6 wt. % and the Ce in the range of 0.01 to 0.5 wt. %, Mg and Zn maintained in a ratio in the range of 0.1 to less than 1, the balance aluminum, elements and incidental impurities;

(b) heating the body to a temperature in the range of 700° to 900° F. for a series of low temperature hot rolling operations to put said body in a condition for recrystallization;

(c) subjecting the heated body to at least two low temperature hot rolling operations wherein the first low temperature hot rolling operation is provided at a temperature higher than the temperature of the second low temperature operations to provide an intermediate flat rolled product having a thickness 1.5 to 15 times that of a final product;

(d) recrystallizing said intermediate product at a temperature in the range of 900° to 1040° F.;

(e) hot rolling the recrystallized product to a final thickness product, said hot rolling of the recrystallized product starting at a temperature of 900° F. and below 1040° F.;

(f) solution heat treating and quenching the final product; and (g) aging said final product to provide a final product having said improved levels of properties.

32. The method in accordance with claim 31 wherein said final product contains less than 0.08 wt. % Zr and is recrystallized.

33. The method in accordance with claim 31 wherein the first low temperature hot working is performed at a temperature in the range of 500° to 850° F.

34. The method in accordance with claim 31 wherein the second low temperature hot working is performed at a temperature in the range of 400° to 500° F.

35. A method of making lithium containing aluminum base flat rolled products having improved corrosion resistance and having improved toughness properties for plate and improved anisotropy for sheet, the method comprising the steps of:

(a) providing a body of aluminum base alloy consisting essentially of 0.2 to 5.0 wt. % Li, 0.05 to 6.0 wt. % Mg, at least 2.45 wt. % Cu, 0.1 to 1.0 wt. % Mn, 0.05 to 6.0 wt. % Zn, 0.5 wt. % max. Fe, 0.5 wt. % max. Si, at least one of the elements selected from the group Cr, V, Hf, Zr, Ti, Sc and Ce with Cr, V, Zr, Ti and Sc in the range of 0.01 to 0.2 wt. %, Hf up to 0.6 wt. % and Ce in the range of 0.01 to 0.5 wt. %, Mg and Zn maintained in a ratio in the range of 0.1 to less than 1, the balance aluminum and incidental impurities;

(b) bringing the body to a temperature for at least one low temperature hot working operation to put said body in a condition for recrystallization;

(c) subjecting said body to at least one controlled low temperature hot working operation to provide an intermediate product;

(d) recrystallizing said intermediate product;

(e) cold rolling the recrystallized product; and (f) solution heat treating, quenching and aging said product after cold rolling to provide a product having a metallurgical structure generally lacking intense work texture characteristics, said product having said improved levels of properties.

36. The method in accordance with claim 35 wherein during cold rolling the product is provided with intermediate anneals.

37. The method in accordance with claim 35 wherein after cold rolling the product is subjected to controlled anneal wherein the temperature is raised from about 750° F. to 950° F. at a rate in the range of 2° to 200° F./hr.

38. An aluminum base alloy flat rolled product having improved corrosion resistance and having the ability to develop improved toughness properties for plate and improved anisotropy for sheet, the the product consisting essentially of 0.2 to 5.0 wt. % Li, 0.05 to 6.0 wt. % Mg, at least 2.45 wt. % Cu, 0.1 to 1.0 wt. % Mn, 0.05 to 6.0 wt. % Zn, 0.5 wt. % max. Fe, 0.5 wt. % max. Si, at least one of the elements selected from the group Cr, V, Hf, Zr, Ti, Sc and Ce with Cr, V, Zr, Ti and Sc in the range of 0.01 to 0.2 wt. %, Hf up to 0.6 wt. % and Ce in the range of 0.01 to 0.5 wt. %, Mr and Zn maintained in a ratio in the range of 0.1 to less than 1, the balance substantially aluminum, incidental elements and impurities, the product having said improved levels of properties in the aged condition.

39. The product in accordance with claim 38 wherein Mg is in the range of 0.2 to 2.0 wt. %.

40. The product in accordance with claim 38 wherein Zn is in the range of 0.2 to 2.0 wt. %.

41. The product in accordance with claim 38 wherein Li is in the range of 1.5 to 3.0 wt. %, Mg is in the range of 0.2 to 2.5 wt. %, Zn is in the range of 0.2 to 2.0 wt. %, Cu, is in the range of 2.55 to 2.90 wt. % and Mn is in the range of 0.1 to 0.8 wt. %.

42. The product in accordance with claim 38 wherein the wrought product has a substantially unrecrystallized metallurgical structure generally lacking intense work texture characteristics.

43. An aluminum base alloy wrought product having improved corrosion resistance and having the ability to form a recrystallized intermediate product after low temperature hot working and a substantially unrecrystallized structure after being solution heat treated, the product consisting essentially of 0.2 to 5.0 wt. % Li, 0.05 to 2.0 wt. % Mg, at least 2.45 wt. % Cu, 0.1 to 1.0 wt. % Mn, 0.05 to 2.0 wt. % Zn, 0.5 wt. % max. Fe, 0.5 wt. % max. Si, at least one of the elements selected from the group Cr, V, Hf, Ti, Zr, Sc and Ce, with Cr, V, Ti, and Sc and Zr in the range of 0.01 to 0.5 wt. %, Mg and Zn maintained in a ratio in the range of 0.1 to less than 1, the balance substantially aluminum, incidental elements and impurities, the product having improved toughness properties for plate and improved anisotropy for sheet in the aged condition.

44. An aluminum base alloy wrought product having improved corrosion resistance and having the ability to form a recrystallized intermediate product after low temperature hot working and a substantially unrecrystallized structure after being hot worked and solution heat treated, the product consisting essentially of 1.8 to 2.5 wt. % Li, 0.2 to 2.0 wt. % Mg, 2.5 to 2.9 wt. % Cu, 0.1 to 0.8 wt. % Mn, up to 0.10 wt. % Zr, 0.2 to 2.0 wt. % Zn, 0.5 wt. % max. Fe, 0.5 wt. % max., Si, Mg and Zn maintained in a ratio in the range of 0.1 to less than 1, the balance substantially aluminum, incidental elements and impurities, having improved toughness properties for plate and improved anisotropy for sheet in the aged condition.

45. The product in accordance with claim 38 wherein said product has a Mg-Zn ratio of 0.2 to 0.9.

46. The product in accordance with claim 38 wherein said product has a Mg-Zn ratio of 0.3 to 0.8.

* * * * *

UNITED STATES PATENT AND TRADEMARK OFFICE

CERTIFICATE OF CORRECTION

PATENT NO. : 5,066,342

DATED : November 19, 1991

INVENTOR(S) : Roberto J. Rioja, Joel A. Bowers & R. Steve James

It is certified that error appears in the above-identified patent and that said Letters Patent is hereby corrected as shown below:

| | |
|---|---|
| Col. 6, line 29 | Change "ahort" to --short--. |
| Col. 18, line 15<br>Claim 43 | After "0.01 to", insert --0.2 wt.% and Hf up to 0.6 wt.%, Ce in the range of 0.01 to--. |

Signed and Sealed this

Twenty-second Day of June, 1993

*Attest:*

Michael K. Kirk

MICHAEL K. KIRK

*Attesting Officer*

*Acting Commissioner of Patents and Trademarks*